US005316159A

United States Patent [19]

Douglas et al.

[11] Patent Number: 5,316,159

[45] Date of Patent: May 31, 1994

[54] DUAL BOTTLE CONTAINER

[75] Inventors: Jerry A. Douglas, Harrisburg, Ill.; Godfried Schmidt, Redondo Beach, Calif.

[73] Assignee: Plastic Processing Corporation, Gardena, Calif.

[21] Appl. No.: 916,532

[22] Filed: Jul. 20, 1992

Related U.S. Application Data

[63] Continuation-in-part of Ser. No. 791,009, Nov. 12, 1991, abandoned, which is a continuation of Ser. No. 662,827, Mar. 1, 1991, Pat. No. 5,158,191.

[51] Int. Cl.[5] ..... B65D 23/08; B65D 21/02; B65D 25/38

[52] U.S. Cl. ..... 215/10; 206/432; 206/504; 222/142.9; 222/143; 220/23.4; 220/23.83

[58] Field of Search ..... 215/10, 6; 220/23.4, 220/23.83; 206/504, 432; 222/142.9, 143

[56] References Cited

U.S. PATENT DOCUMENTS

| | | | |
|---|---|---|---|
| 59,333 | 10/1866 | Bullard | 215/10 |
| 225,143 | 3/1880 | Kahler | 222/142.9 X |
| 787,986 | 4/1905 | Kelliher | 215/6 |
| 1,568,160 | 1/1926 | Hibbert | 222/142.9 |
| 1,739,363 | 12/1929 | Kraft | 222/142.3 |
| 1,976,622 | 10/1934 | McIntyre | 220/23.4 X |
| 2,182,623 | 12/1939 | Dolar | 222/142.3 |
| 2,665,816 | 1/1954 | Anft | 220/524 |
| 2,754,962 | 7/1956 | Scrymgeour | 220/23.4 X |
| 2,890,816 | 6/1959 | Horland | 222/142.9 X |
| 3,194,426 | 7/1965 | Brown, Jr. | 220/23.4 |
| 3,269,389 | 8/1966 | Meurer et al. | 215/6 |
| 3,533,526 | 10/1970 | Adell | 215/10 X |
| 3,851,936 | 12/1974 | Muller | 206/504 X |
| 4,133,445 | 1/1979 | Mandelbaum | 220/23.4 |
| 4,165,812 | 8/1979 | Jennison | 220/23.4 X |
| 4,196,808 | 4/1980 | Pardo | 206/432 |
| 4,300,681 | 11/1981 | Klygis et al. | 206/432 X |
| 4,377,234 | 3/1983 | Kaplan | 206/432 |
| 4,381,841 | 5/1983 | Schwarz | 215/10 X |
| 4,416,373 | 11/1983 | deLarosiere | 206/432 |
| 4,509,639 | 4/1985 | Thompson | 220/23.4 X |
| 4,624,383 | 11/1986 | Moore | 220/23.4 |
| 4,685,565 | 8/1987 | Sparling | 215/10 X |
| 5,135,823 | 8/1992 | Eales | 220/23.83 X |
| 5,185,191 | 10/1992 | Douglas et al. | 215/10 |

FOREIGN PATENT DOCUMENTS

| | | | |
|---|---|---|---|
| 366638 | 6/1923 | Fed. Rep. of Germany | 215/6 |
| 456287 | 2/1928 | Fed. Rep. of Germany | 220/23.4 |
| 2115693 | 10/1972 | Fed. Rep. of Germany | 206/504 |
| 2212075 | 10/1972 | Fed. Rep. of Germany | 220/23.4 |
| 2365013 | 7/1975 | Fed. Rep. of Germany | 220/23.4 |
| 2713543 | 10/1978 | Fed. Rep. of Germany | 220/23.4 |
| 838832 | 3/1939 | France | 220/23.4 |
| 1099180 | 8/1955 | France | 220/23.4 |
| 1565458 | 5/1969 | France | 220/23.4 |
| 2552734 | 4/1985 | France | 215/10 |
| 2221666 | 2/1990 | United Kingdom | 215/100 R |
| 444745 | 1/1949 | Italy | 215/6 |
| 9204978 | 4/1992 | PCT Int'l Appl. | 215/6 |

*Primary Examiner*—Sue A. Weaver
*Attorney, Agent, or Firm*—Nilsson, Wurst and Green

[57] ABSTRACT

A dual bottle container has two bottles which are releasably interlocked together in side-by-side relation by a plateau on one of the bottles which engages a depression on the other bottle for transverse sliding movement. The plateau is bordered at opposite sides by rounded lip portions and the depression is bordered at opposite sides by rounded groove portions, the lip portions and the groove portions engaging each other to prevent undesired relative movement between the two bottles.

28 Claims, 4 Drawing Sheets

DUAL BOTTLE CONTAINER

This application is a continuation-in-part of application Ser. No. 07/791,009 filed Nov. 12, 1991 now abandoned, which in turn is a continuation of application Ser. No. 07/662,827, filed Mar. 1, 1991, U.S. Pat. No. 5,158,191.

BACKGROUND OF THE INVENTION

This invention relates to a liquid container, and, in particular, to a dual container having two different bottle portions releasably joined for handling and use.

There are many products which are used together, such as shampoo and hair conditioner, ketchup and mustard, and oil and vinegar. These products are generally provided in two separate containers. Thus, the end-user must keep separate bottles together. For example, after shampooing, it may be difficult for a person in the shower to find a separate conditioner bottle. It is thus desirable to be able to store these related products together so that both may be readily available at the same time.

Dual containers, per se, have been shown in the past. U.S Pat. No. 4,196,808 to Pardo, for example, shows a pair of containers which, as disclosed, may be bonded together or may be held together by shrink wrap. This provides for two containers which are either held together as a unit or are separate. The disadvantage in this is that if one container is emptied before the other, the empty container cannot be readily replaced with a fresh container of the used product.

U.S. Pat. No. 3,194,426, to Brown, Jr. and U.S. Pat. No. 4,133,445, to Mandelbaum, disclose containers which are removably connected. The Brown, Jr. containers use longitudinal dovetails to lock the containers together and a detent to prevent relative movement of the bottles along the axis of the connection. The Mandelbaum containers, which are designed to store different types of pills for use together, have a large number of transversely oriented dovetail connections joining each container. However, the structures of Brown, Jr. and Mandelbaum are not well suited to many applications. The longitudinal dovetails of Brown, Jr. require more force to join or separate the bottles than can be easily applied, particularly when the bottles are made of plastic. The plurality of small transverse dovetails of Mandelbaum might require less force, but would be cumbersome to align and would not be stable against lateral bending forces.

Therefore, it is desirable in many applications to provide a structure permitting a plurality of containers to be readily joined and separated by a simple manual motion and yet providing a rugged connection in the joined condition.

SUMMARY OF THE INVENTION

The dual bottle container of the present invention has a unique interlock system which permits a pair of separate bottles to be positively joined and easily separated by simple transverse relative movements. In a preferred embodiment, the two bottles have generally planar walls with substantially complementary interlocking portions thereon. The generally planar wall of one of the bottles has a raised area forming a substantially flat plateau bordered on opposite sides by rounded lip portions. The planar wall of the other bottle has a recessed area forming a substantially flat depression bordered on opposite sides by rounded groove portions. The plateau is slidable within the depression to cause the rounded lip portions to engage the rounded groove portions as the bottles are moved to a predetermined engaged position wherein the generally planar walls are in close, face-to-face relation. This engagement prevents relative movement of the bottles transverse to the direction of sliding movement and facilitates joinder and separation of the bottles. The rounded groove portions are preferably undercut into the generally planar wall portion of the second bottle, and the rounded lip portions and the rounded groove portions are both preferably tapered in a plane parallel to the generally planar wall portions so that they engage each other along only a portion of their length. Opposite ends of the lip portions and groove portions are preferably tapered to form gradual peaks directed away from the substantially flat plateau and toward the substantially flat depression, respectively. In a further embodiment, the dual bottle container is provided with a detent structure in the form of at least one rib on one of the bottles receivable within an indentation on the other of the bottles to releasably hold the bottles together once they are engaged.

The disclosed structure minimizes friction between the two bottles by minimizing the surfaces over which they contact one another. Nevertheless, the bottles are held together securely in the joined condition. The primary contact is between the rounded lip portions of the plateau on one bottle and the rounded groove portions of the depression on the other bottle. By their nature, these surfaces interfit smoothly and freely, even when they and their respective bottles are made of plastic materials. In addition, the lip portions and the groove portions are preferably tapered and radiused at their ends to reduce contact between the bottles even further. Thus, the user need not accurately align the bottles or apply substantial force to them at the beginning of the movement by which the bottles are joined. The lip portions and groove portions, in combination with their respective plateau and depression regions, actually aid in providing the proper alignment. The radiused ends and the tapered contours of these connecting portions tend to "cam" the bottles up or down relative to each other during the joinder process, resulting in accurate alignment of the two bottles in the fully engaged position.

BRIEF DESCRIPTION OF THE DRAWINGS

The above and other features of the present invention may be more fully understood from the following detailed description, taken together with the accompanying drawings, wherein similar reference characters refer to similar elements throughout and in which.

DESCRIPTION OF THE PREFERRED EMBODIMENT

Figure 1:
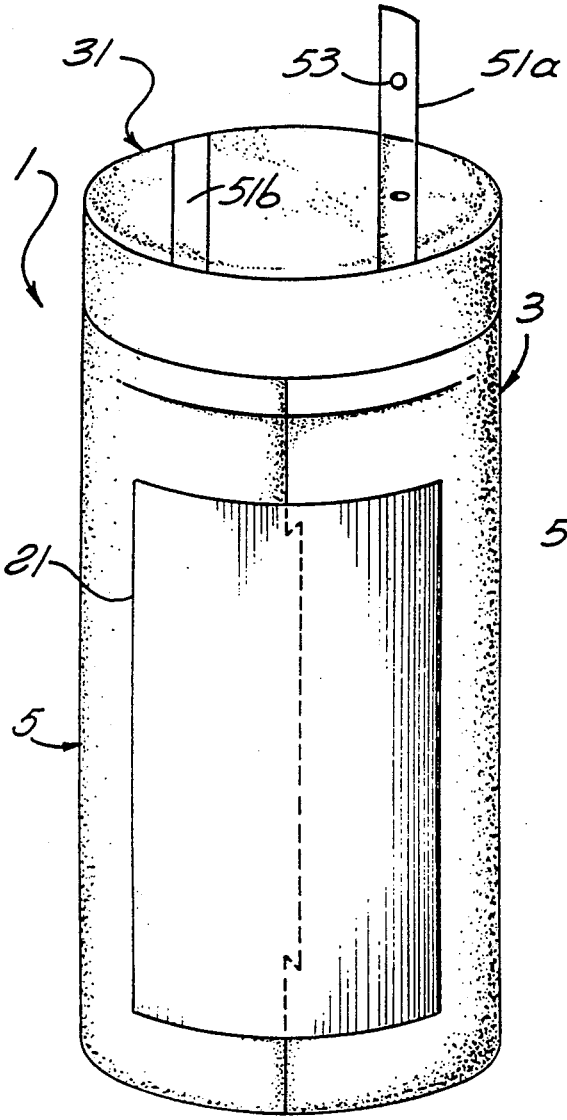
FIG. 1 is a perspective view of a dual bottle container constructed according to a preferred embodiment of the present invention with a cap thereon and a label across the front thereof.
Figure 2:
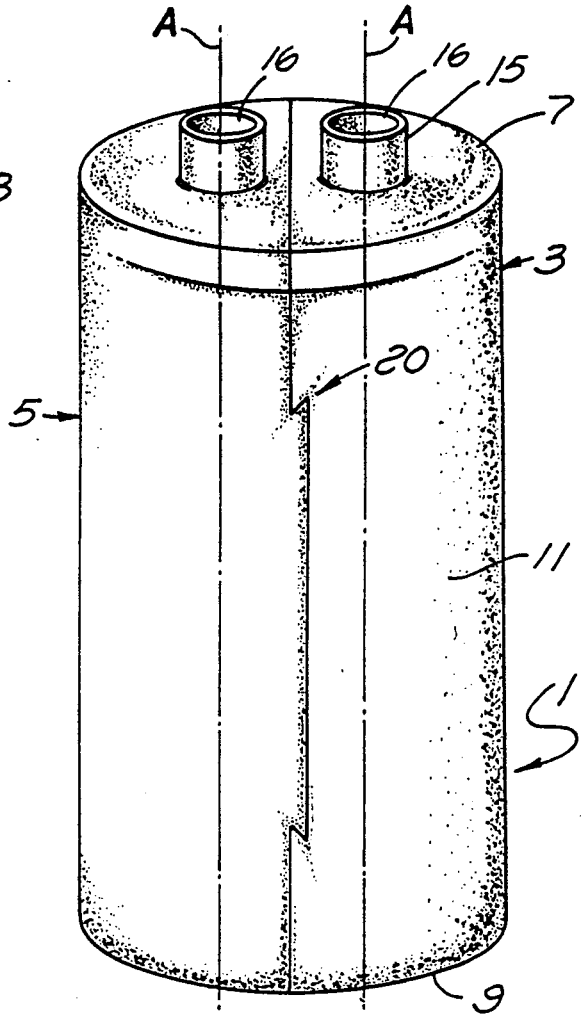
FIG. 2 is a perspective view of the dual bottle container of FIG. 1 without the cap and the label.
Figure 3:
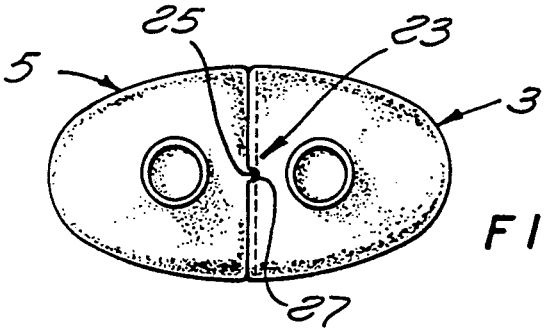
FIG. 3 is a top plan view of the dual bottle container of FIG. 2 showing a detent for preventing relative lateral movement of the bottles from their interlocked position.
Figure 4:
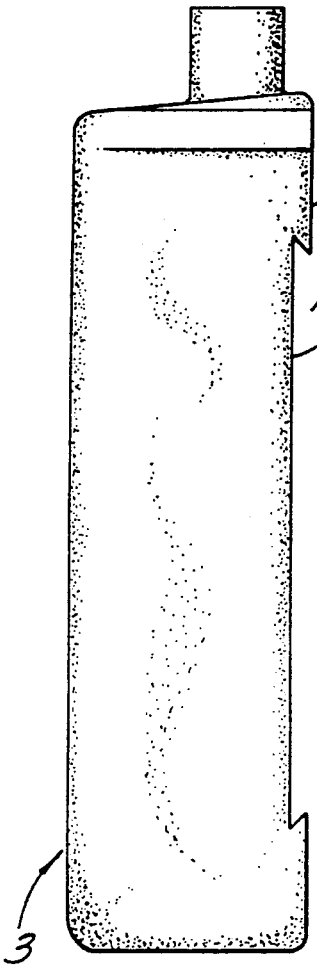
FIGS. 4 and 5 are front elevational views of the two bottles of the container of FIG. 2 separated from one another.
Figure 5:
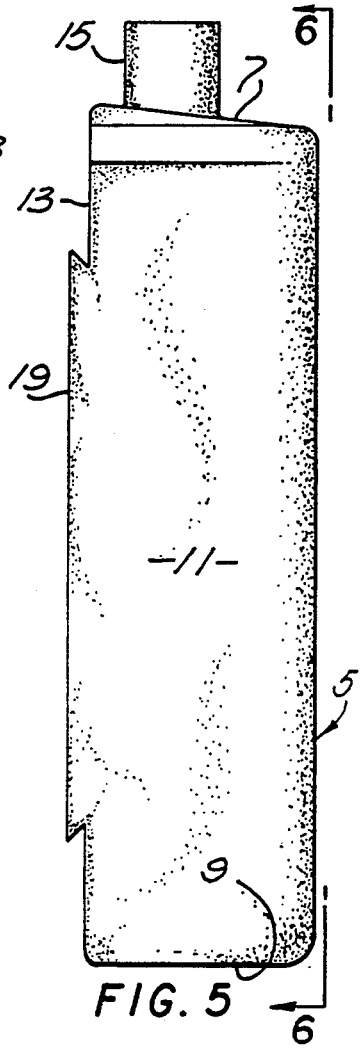
Figure 6:
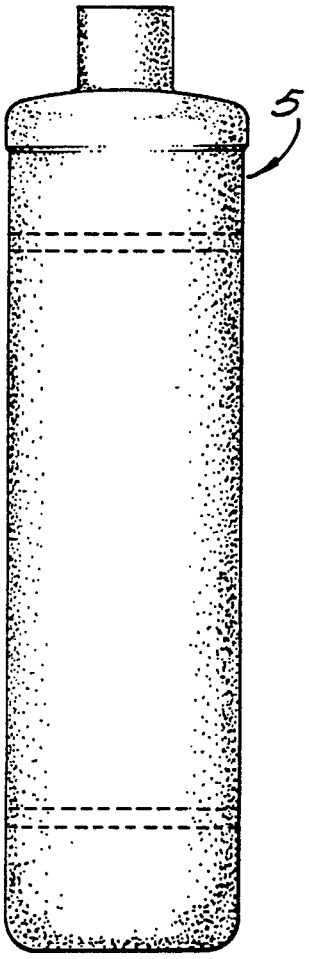
FIG. 6 is a side elevational view of one of the bottles, the side elevational views of the two bottles being identical.

Referring to the drawings, and in particular to FIG. 1, reference numeral 1 represents a dual bottle container constructed according to a preferred embodiment of the present invention. The container 1 includes two bottles 3 and 5 which are preferably made from a pliable, deformable synthetic polymeric material, such as polyethylene or other plastic. Each of the bottles 3 and 5 has a top wall 7, a bottom 9, an arcuate outside wall 11, a generally planar side wall 13 and a longitudinal axis A extending heightwise of the bottle. A neck 15 protrudes up from the bottle top wall 7 and defines a mouth 16 of the bottle. The side wall 13 of the bottles 3 and 5 have a dovetail mortise and tenon 19, respectively, for transversely interlocking the bottles together in a predetermined side-by-side position in which the generally planar side walls 13 of the bottles are in close face-to-face relation, as shown in FIGS. 1 and 2. The mortise and tenon extend transversely across the walls 13 to join the bottles together so that the top walls 7, the bottom walls 9 and the sides 11 are substantially coplanar. Thus the walls 13 are in face-to-face abutting relation.

The mortise and tenon 19 extend transversely across the walls 13 and are dovetailed so as to prevent relative vertical and side-to-side horizontal movement of the bottles 3 and 5. The only relative movement of the bottles possible is motion in the direction of the dovetail. In a preferred embodiment, the mortise and tenon 19 cover at least approximately one-half of the surface area of the generally planar side walls 13.

The relative transverse motion of the bottles can be prevented by adhering a label 21 to both of the bottles so that it covers the mortise 17 and the tenon 19, as can be seen in FIG. 1. Thus, the label 21, releasably holds the bottles 3 and 5 together such that if the product in one bottle is used up before the product in the other, the label can be broken and the empty bottle can be replaced with a fresh bottle.

A detent 23 (detent means) may also be used to prevent relative transverse movement of the bottles 3 and 5. The detent 23 includes rib means comprising a semicircular rib 25 which extends longitudinally along the side 13 of the bottle 5 and an indentation 27 on the side 13 of the bottle 3. The rib 25 and the indentation 27 are positioned on their respective walls so that they mate releasably to hold the two bottles in the stated predetermined side-by-side position in which the outside walls 11 of the bottles combine to provide for a smooth or uninterrupted outer-surface to the container 1. The detent 23 facilitates the juncture of the bottles 3 and 5 but does not require the application of undue manual force to result in their separation. The bottles 3 and 5 are preferably made of a resilient material, such as plastic (e.g., high density polyethylene), so that by exerting sufficient manual force, the walls 13 will deform (if required) allowing the rib 25 to slide out of the indentation 27 and thereby allowing separation of the bottles 3 and 5.

In accordance with this invention, the necks 15 of the container 1 are closed by cap means which, as shown in FIG. 1, is a unitary cover 31. The cover 31 includes openings 33 which define outlets for the bottles 3 and 5, respectively. The openings 33 can be opened and closed independently of each other. Thus, the cover 31 need not be removed from the container 1. Accordingly, the cover provides another mechanism for preventing relative transverse motion of the bottles 3 and 5.

Figure 7:
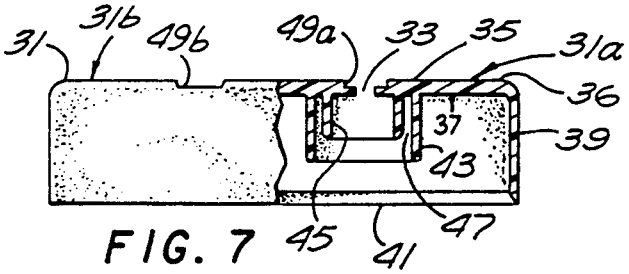
FIG. 7 is an elevational view of the cap, partially cut away.
Figure 9:
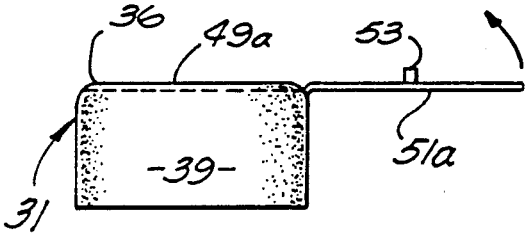
FIG. 9 is a side elevational view taken along the line 9—9 of FIG. 8.
Figure 8:
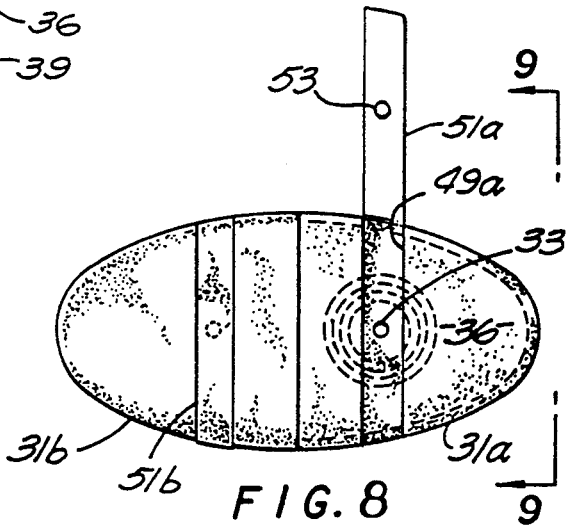
FIG. 8 is a top plan view of the cap showing a closure for an opening of the cap in its open condition.

As shown in FIGS. 7-9, the cover 31 includes two identical halves 31*a* and 31*b*, only one of which will be described. Each cover half includes a top 35 having an exterior surface 36 and an interior surface 37, a side wall 39, and an open bottom 41. A first cylinder 43 depends from the interior surface 37 of the top 35. It is positioned such that it is concentric with and so it fits over the outside of the neck 15 of the bottle 3 or 5 when placed on the container 1. A second cylinder 45 depends downwardly from the top inner surface 37 concentrically within the first cylinder 43. The second cylinder 45 is sized to be received within the neck 15 when the cover 31 is placed on the container 1. The cylinders 43 and 45 define an annular groove 47 which receives the neck 15. The fit of the neck 15 in the groove 47 is preferably snug so that the cover 31 will not readily come off of the container 1 and so that the neck is sealed relative to the cap.

Slots 49*a*, 49*b* are formed in the top exterior surface 36. Each slot 49 extends across the cover 31 from the front to the back thereof. The opening 33 is formed within each slot 49*a*, 49*b*. Arms 51*a*, 51*b* are hingedly connected to the cap 31 so that they may be received in a respective slot 49*a*, 49*b*. Each arm 51*a*, 51*b* includes a pin 53 which is sized and positioned to sealably snap fit into a respective opening 33 when the arm is swung down into its slot 49*a*, 49*b* so as to close the bottle outlet. Each arm is preferably as long as its slot 49*a*, 49*b*, as can be seen in FIGS. 1 and 8.

Figure 10:
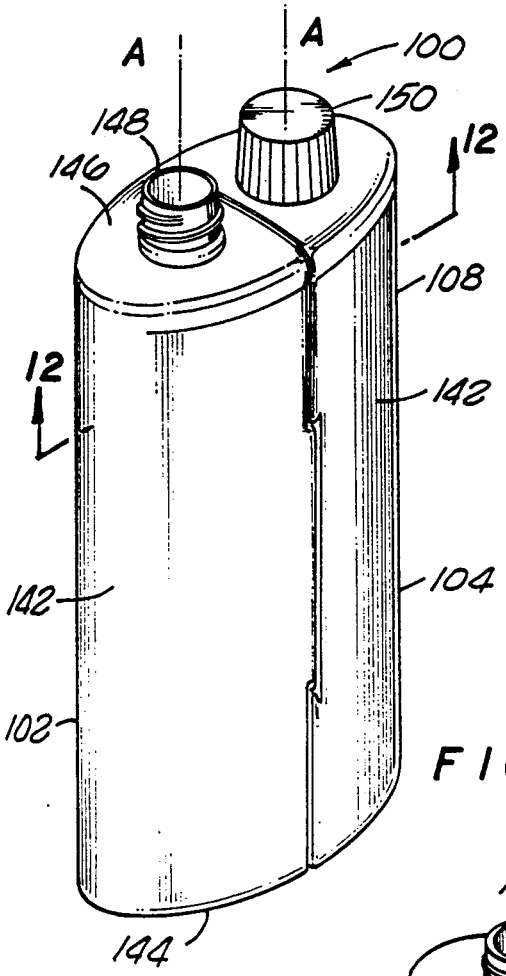
FIG. 10 is a perspective view of a dual bottle container constructed according to another preferred embodiment of the present invention, with a cap on one of the individual containers.
Figure 12:
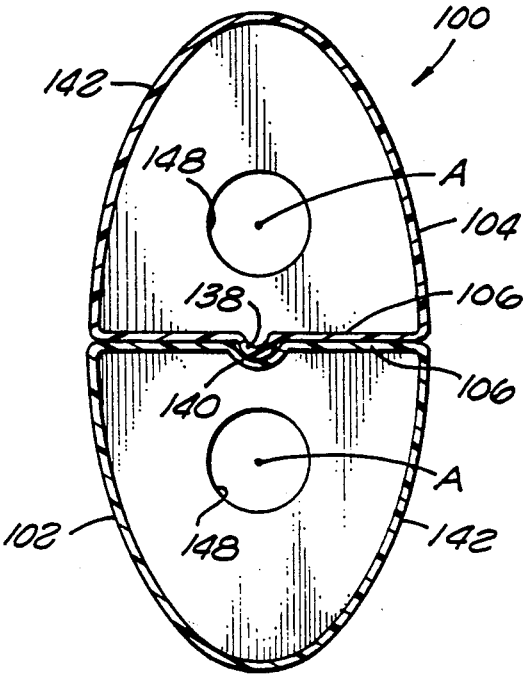
FIG. 12 is a horizontal sectional view taken along the line 12—12 of FIG. 10.
Figure 11:
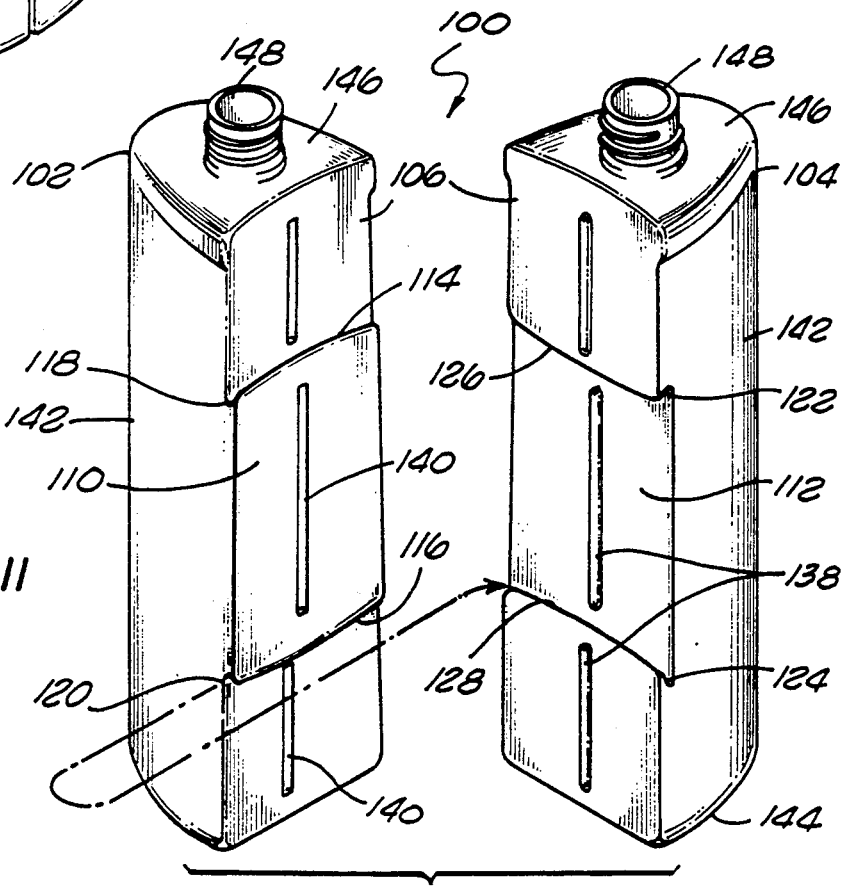
FIG. 11 is an exploded perspective view of the two containers of FIG. 10 in the separated condition.

Referring now to FIGS. 10-12, which illustrate a dual bottle container constructed according to another preferred embodiment of the present invention, the container 100 is made up of a first bottle 102 and a second bottle 104 releasably joined along substantially planar side walls 106 to form a composite structure having a generally continuous arcuate outer surface 108. The bottles are joined by a substantially flat plateau 110 of the bottle 102 which engages a substantially flat depression 112 of the bottle 104. The plateau 110 and the depression 112 are formed in the planar side walls 106 of the respective bottles and extend transversely over the width of the side walls. Thus, the plateau 110 is slidably receivable within the depression 112 for joinder of the bottles in the manner shown in FIG. 11

The primary surfaces of engagement between the plateau 110 and the depression 112 are located at the upper and lower boundaries of the two elements and are specially configured for ease of operation. Thus, the plateau 110 is bordered by rounded lip portions 114 and 116 at its upper and lower ends, respectively, which extend vertically beyond the remainder of the plateau portion to define channels 118 and 120. Similarly, the depression 112 of the bottle 104 is bordered by upper and lower rounded groove portions 122 and 124, respectively, formed within the substantially planar side wall 106 of the bottle 104. This results in a pair of rounded or blunt edge portions 126 and 128 which extend inwardly toward the depression 112.

Figure 14:
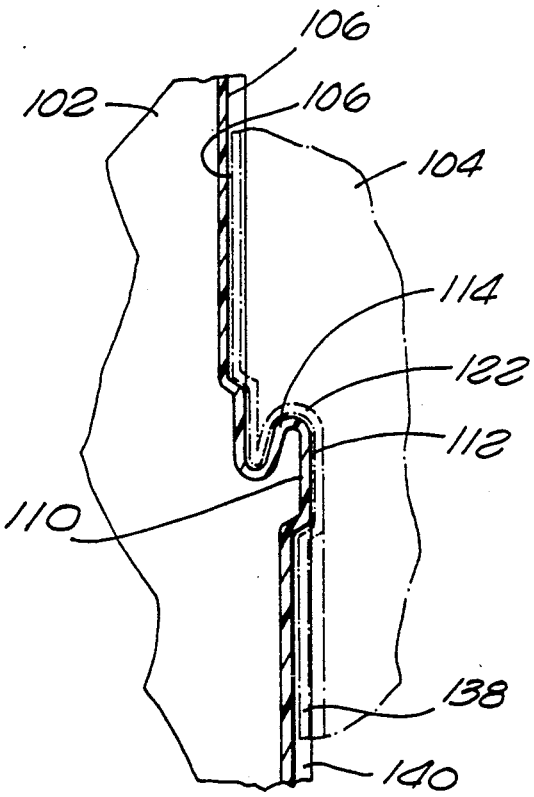
FIG. 14 is a greatly enlarged vertical sectional view taken along the line 14—14 of FIG. 13.

The lip portions 114 and 116 and the groove portions 122 and 124 are "rounded" in the sense that they have a rounded cross section which minimizes friction and binding between the parts. This characteristic of the connecting structure is seen most clearly in FIG. 14.

The plateau 110 is received within the depression 112 for sliding movement such that the rounded lip portions 114 and 116 engage the rounded groove portions 122 and 124 for smooth sliding movement between the joined (FIG. 10) and separated (FIG. 11) conditions of the dual container 100. In a preferred embodiment, the plateau 110 and the depression 112 cover approximately one-half of the surface area of the substantially planar walls 106.

Figure 13:
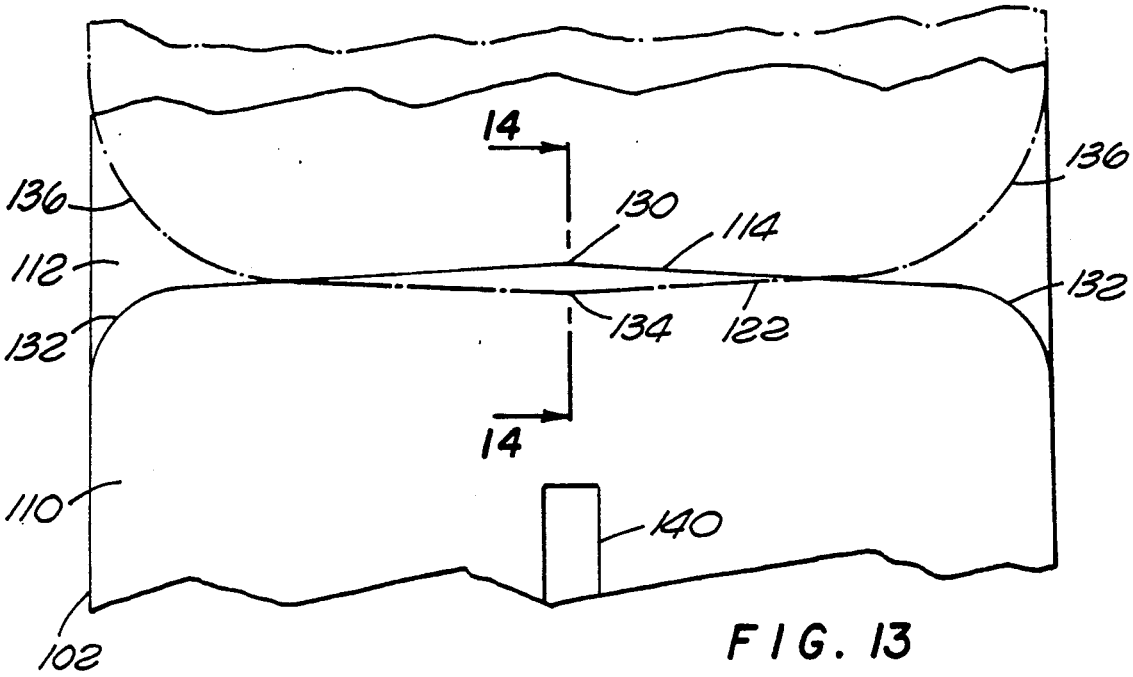
FIG. 13 is a greatly enlarged side elevational view of the bottle on the left hand side of FIG. 11 showing the upper portion of a plateau region thereof, the interfitting groove portion of the other bottle being shown in phantom line.

The sliding engagement of the bottles is further facilitated by other structural features of the lip and groove portions, as illustrated in FIG. 13. FIG. 13 shows that the rounded lip portion 114 tapers outwardly within the plane of the plateau 110 from a maximum or "peak" 130 to a pair of radiused outer ends 132. Similarly, the rounded groove portion 122, shown in phantom line in FIG. 13, also tapers outwardly within the plane of the depression 112 from a "peak" 134 to a pair of radiused outer ends 136. As illustrated, the outer ends 136 of the groove portion 122 are preferably curved to a larger radius than the outer ends 132 of the plateau 110. Of course, these features apply to all of the rounded lip portions and rounded groove portions of the container 100.

The tapered configuration of the lip portion 114 and groove portion 122 further reduces friction and any tendency of the parts to "bind" during sliding movement. As a result of this double taper, the lip portion 114 of the plateau 110 does not interfere with, or even engage, the structure of the groove portion 122 until the two bottles are slid together (FIG. 11) approximately one-third of the distance toward the fully joined condition (FIG. 10). In the fully joined condition, the peak 130 of the lip portion 114 overlaps the peak 134 of the groove portion 122 to hold the bottles together against longitudinal (vertical) forces. The outer ends of the lip portion 114 and the groove portion 122, however, do not overlap, as shown in FIG. 13, due to the tapered profiles of the two elements. In addition, the radiused outer ends 132 and 136 prevent interference of the parts, and therefore binding of the bottles, in the early stages of the joining process. In fact, the extreme radiuses provided on these elements causes them to cam the two bottles up or down until they are aligned. Thus, the plateau and depression structure of the container 100 advantageously contributes to the proper alignment of the bottles in the joinder process.

The bottles 102 and 104 are held in the joined condition of FIG. 10 by a detent structure illustrated most clearly in FIGS. 11 and 12. The bottle 104 has longitudinal rib segments 138 which engage longitudinal indentations 140 of the bottle 102 to "lock" the bottles in a joined, side-by-side relationship with the substantially planar side walls 106 closely abutting each other. This condition is shown in cross section in FIG. 12, wherein the rib segment 138 is received within the indentation 140 to resist sliding movement of the plateau 110 within the depression 112. When it is desired to separate the two bottles, a greater force is applied in the direction of sliding movement to release the rib segment 138 from the indentation 140. This additional required force is nominal, however, due to the easily deformable character of the side wall 106. Nevertheless, the retaining force is sufficient to hold the bottles together under normal use.

Although the present invention applies to a wide variety of bottles having at least one substantially planar wall surface, a preferred form of the invention, shown in FIGS. 10 and 11, incorporates a vertically-oriented bottle having a substantially arcuate side wall 142, a bottom wall 144 and a top wall 146 with a threaded neck directed along an axis A. The neck 148 can be closed by a cap 150 of the type illustrated in FIG. 10, or can be provided with dispensing means, such as a spray nozzle.

As with the container 1 of FIGS. 1–6, the container 100 can be made of any suitable material, but is preferably formed of a synthetic polymeric material, such as polyethylene. Although the container can be manufactured by other suitable methods, the most advantageous method is believed to be blow molding. The caps 150 are typically injection molded.

The relative dimensions and configuration of the bottles 102 and 104 are, of course, subject to wide variation; however, certain basic tolerances and angular relationships are preferred. Thus, the plateau 110 preferably extends approximately 0.100 inches (2.60 mm) above the planar side wall 106 of the first bottle 102, in which case the depth of the depression 112 should be between 0.105 inches (2.73 mm) and 0.110 inches (2.86 mm) so that the plastic surfaces will slide loosely and will not stick or bind together. On the other hand, the rib segments 138 and the indentations 140 preferably have an interference fit of approximately 0.010 inches (0.26 mm) to provide adequate "locking" force. Finally, the angle of lateral taper of the rounded lip portions 114 and 116, and the rounded groove portions 122 and 124, is preferably between approximately one-half degree and one degree. This forms gradual peaks 130 and 134 which cause the overlapping condition of FIG. 13 without producing high levels of friction between components.

From the above, it can be seen that the individual bottles of the dual bottle container disclosed herein can be separated and rejoined with minimal force and alignment effort. The character and orientation of the engaging surfaces are specifically tailored to minimize friction without reducing the stability of the connection between the bottles in the joined condition.

While certain specific embodiments of the invention have been disclosed as typical, the invention is not limited to those particular forms, but rather is applicable broadly to all such variations as fall within the scope of the appended claims.

What is being claimed is:

1. A dual bottle container comprising:
first and second bottles each having a generally planar wall portion extending from a front surface to a back surface of said bottle, and a longitudinal axis extending heightwise of the bottle;
the generally planar wall portion of the first bottle having a raised portion forming a substantially flat plateau extending transversely with respect to the longitudinal axis of the bottle and bordered on opposite sides by rounded lip portions;
the generally planar wall portion of the second bottle having a recessed portion forming a substantially flat depression extending transversely with respect to the longitudinal axis of the bottle and bordered on opposite sides by rounded groove portions;
at least one of the rounded lip portions or the rounded groove portions being tapered at opposite ends to form a peak;
the plateau being receivable within the depression in a sliding relationship to engage the rounded lip portions of the first bottle with the rounded groove portions of the second bottle as the two bottles are moved to a predetermined engaged position in which said generally planar wall portions are in close face-to-face relation.

2. The dual bottle container of claim 1 wherein:
the rounded lip portions of the plateau engage the rounded groove portions of the depression to prevent relative movement of the bottles transverse to the direction of sliding movement.

3. The dual bottle container of claim 2 wherein:
the rounded groove portions are undercut into the generally planar wall portion of the second bottle.

4. The dual bottle container of claim 2 wherein:
the rounded lip portions are tapered in a plane parallel to the generally planar wall portion of the first bottle to engage the rounded groove portions of the second bottle along only a portion of the length of said groove portions when the bottles are in said predetermined joined position.

5. The dual bottle container of claim 4 wherein:
each of the rounded lip portions is tapered at opposite ends to form a peak directed outwardly from said substantially flat plateau.

6. The dual bottle container of claim 2 wherein:
the rounded groove portions are tapered in a plane parallel to the generally planar side wall of the second bottle to engage the rounded lip portions of the first bottle along only a portion of the length of said lip portions when the bottles are in said predetermined joined position.

7. The dual bottle container of claim 6 wherein:
each of the rounded groove portions is tapered at opposite ends to form a peak directed inwardly toward said substantially flat depression.

8. The dual bottle container of claim 2 wherein:
the rounded groove portions of the second bottle have radiused outer ends to facilitate sliding movement of the bottles to said predetermined joined position.

9. The dual bottle container of claim 8 wherein:
the rounded lip portions of the first bottle have radiused outer ends to facilitate sliding movement of the bottles to said predetermined joined position.

10. The dual bottle container of claim 9 wherein:
the outer ends of the rounded groove portions are curved to a larger radius than the outer ends of the rounded lip portions.

11. The dual bottle container of claim 1 wherein:
the first and second bottles have substantially arcuate outside walls including said front and back surfaces, said substantially arcuate outside walls combining to form a substantially smooth, uninterrupted outside surface of the container when the two bottles are joined in said predetermined joined position.

12. The dual bottle container of claim 1 wherein:
said plateau and said depression cover approximately one-half of the surface area of said planar wall portions.

13. A dual bottle container comprising:
first and second bottles each having a top wall, a bottom wall, an outside wall, a generally planar side wall and a longitudinal axis extending heightwise of the bottle;
the generally planar side wall of the first bottle having a raised portion forming a substantially flat plateau extending transversely with respect tot he longitudinal axis of the bottle and bordered at upper and lower ends thereof by rounded lip portions;
the generally planar side wall of the second bottle having a recessed portion forming a substantially flat depression extending transversely with respect to the longitudinal axis of the bottle and bordered at upper and lower ends thereof by rounded groove portions;
at least one of the rounded lip portions or the rounded groove portions being tapered at opposite ends to form a peak;
the plateau being receivable within the depression in a sliding relationship generally transversely to the longitudinal axes of the bottles to engage the rounded lip portions with the rounded groove portions as the bottles are moved to a predetermined joined position in which the bottles are side-by-side and said generally planar side walls are in close face-to-face relation.

14. The dual bottle container of claim 13 wherein:
the rounded lip portions of the plateau engage the rounded groove portions of the depression to prevent relative longitudinal movement of the bottles.

15. The dual bottle container of claim 14 wherein:
the rounded groove portions are undercut into the generally planar side wall of the second bottle.

16. The dual bottle container of claim 14 wherein:
the rounded lip portions are tapered in a plane parallel to the generally planar side wall of the first bottle to engage the rounded groove portions of the second bottle along only a portion of the length of said groove portions when the bottles are in said predetermined joined position.

17. The dual bottle container of claim 16 wherein:
each of the rounded lip portions is tapered at opposite ends to form a peak directed outwardly from said substantially flat plateau.

18. The dual bottle container of claim 14 wherein:
the rounded groove portions are tapered in a plane parallel to the generally planar side wall of the second bottle to engage the rounded lip portions of the first bottle along only a portion of the length of said lip portions when the bottles are in said predetermined joined position.

19. The dual bottle container of claim 18 wherein:

each of the rounded groove portions is tapered at opposite ends to form a peak directed inwardly toward said substantially flat depression.

20. The dual bottle container of claim 14 wherein:

the rounded groove portions of the second bottle have radiused outer ends to facilitate sliding movement of the bottles to said predetermined joined position.

21. The dual bottle container of claim 20 wherein:

the rounded lip portions of the first bottle have radiused outer ends to facilitate sliding movement of the bottles to said predetermined joined position.

22. The dual bottle container of claim 21 wherein:

the outer ends of the rounded groove portions are curved to a larger radius than the outer ends of the rounded lip portions.

23. The dual bottle container of claim 13 which further comprises:

detent structures on said generally planar side walls of the first and second bottles to releasably hold said bottles in said predetermined joined position against transverse movement relative to one another.

24. The dual bottle container of claim 23 wherein:

said detent structures comprise at least one rib extending longitudinally of the generally planar side wall of one of the bottles, and at least one indentation extending longitudinally of the generally planar side wall of the other of the bottles, said rib being receivable in the indentation to releasably hold the two bottles against movement relative to one another in the transverse direction.

25. The dual bottle container of claim 24 herein:

the generally planar side walls of the bottles are generally abutting when said rib is received in said indentation.

26. The dual bottle container of claim 13 wherein:

the first and second bottles have substantially arcuate outside walls which combine to form a substantially smooth, uninterrupted outside surface of the container when the two bottles are joined in said predetermined joined position.

27. The dual bottle container of claim 13 wherein:

each bottle has a neck extending substantially up from its top wall and defines a mouth of the bottle;

28. The dual bottle container of claim 27 which further comprises:

caps engageable with the necks of the respective bottles for closing said mouths.

* * * * *